US008019088B2

(12) United States Patent
Holman

(10) Patent No.: US 8,019,088 B2
(45) Date of Patent: Sep. 13, 2011

(54) LOW-FREQUENCY RANGE EXTENSION AND PROTECTION SYSTEM FOR LOUDSPEAKERS

(75) Inventor: Tomlison Holman, Yocca Valley, CA (US)

(73) Assignee: Audyssey Laboratories, Inc., Los Angeles, CA (US)

( * ) Notice: Subject to any disclaimer, the term of this patent is extended or adjusted under 35 U.S.C. 154(b) by 1233 days.

(21) Appl. No.: 11/656,674

(22) Filed: Jan. 23, 2007

(65) Prior Publication Data

US 2008/0175397 A1 Jul. 24, 2008

(51) Int. Cl.
*H03G 11/00* (2006.01)
*H04R 29/00* (2006.01)

(52) U.S. Cl. ..... 381/55; 381/59

(58) Field of Classification Search ..... 381/55, 381/59, 96–98, 102–103, 106, 111, 116–117, 381/120

See application file for complete search history.

(56) References Cited

U.S. PATENT DOCUMENTS 4,113,983 A 9/1978 Steel
4,327,250 A 4/1982 von Recklinghausen
4,583,245 A * 4/1986 Gelow et al. ..... 381/59
4,894,566 A * 1/1990 Rush ..... 327/311
5,481,617 A * 1/1996 Bjerre ..... 381/108
5,577,126 A * 11/1996 Klippel ..... 381/59
5,729,611 A * 3/1998 Bonneville ..... 381/55
6,201,873 B1 3/2001 Dal Farra
6,665,408 B1 12/2003 Schott
6,865,274 B1 3/2005 Aarts
6,931,135 B1 8/2005 Kohut
7,274,793 B2 * 9/2007 Combest et al. ..... 381/55
7,372,966 B2 * 5/2008 Bright ..... 381/55

OTHER PUBLICATIONS

Beranek, Leo L., *Acoustics*, McGraw-Hill, New York, 1954.
Burg, T.C., Gao, X., Dawson, D.M., "Robust control for the improvement of loudspeaker low-frequency response," Southeastcon '93 Proceedings, IEEE, 1993.
"Improving Loudspeaker Signal Handling Capability," Application Note 104, That Corporation, Milford, MA.
Locanthi, B.N., "Application of Electric Circuit Analogies to Loudspeaker Design Problems," *IRE Trans. Audio* PGA-4 (1952), reprinted *J. Audio Eng. Soc.*, vol. 19, pp. 775-785 (1971).
Newman, Raymond J. "Particular vented box loudspeaker system based on a sixth-order Butterworth response function," *J. Acoust. Soc. Am.*, vol. 55, issue S1, Apr. 1974, pp. S29-S30.
Small, Richard H., "Efficiency of Direct-Radiator Loudspeaker Systems," *J. Audio Eng. Soc.*, vol. 19, No. 10, 862-863, Nov. 1971.
Small, Richard H., "Direct Radiator Loudspeaker System Analysis," *J. Audio Eng. Soc.*, vol. 20, No. 5, pp. 383-395.

(Continued)

*Primary Examiner* — Xu Mei
(74) *Attorney, Agent, or Firm* — Kenneth L. Green

(57) ABSTRACT

Low-frequency bandwidth extension in the form of dynamic electrical equalization may be applied to loudspeakers so long as the excursion capability of their drive units as well as velocity limits of any port(s) or excursion limits of any associated passive radiator(s), and the power limits of the drive units are not exceeded. The bandwidth extension maximizes low-frequency bandwidth dynamically such that excursion is fully utilized over a range of drive levels, without exceeding the excursion limit. Additional limiting control is available for port air velocity or passive radiator excursion, and loudspeaker drive unit electrical power. The system applies to open back, closed box, vented box, and more complex box constructions consisting of combinations of these elements for loudspeaker designs using design parameters appropriate to each system.

20 Claims, 6 Drawing Sheets

OTHER PUBLICATIONS

Small, Richard H., "Vented-Box Loudspeaker Systems—Part 2: Large-Signal Analysis," *J. Audio Eng. Soc.*, vol. 21, No. 6, pp. 438-444, Jul./Aug. 1973.

Thiele, A. N., "Loudspeakers in Vented Boxes: Parts I and II," *J. Audio Eng. Soc.*, vol. 19 No. 5 May 1971, pp. 382-392 and No. 6 Jun. 1971, pp. 471-483; a reprint of *Proc. IRE* (*Australia*), vol. 22, p. 487-, 1961.

* cited by examiner

LOW-FREQUENCY RANGE EXTENSION AND PROTECTION SYSTEM FOR LOUDSPEAKERS

BACKGROUND OF THE INVENTION

The present invention relates to electronic signal processing for loudspeakers and in particular to extending the low-frequency capability of loudspeakers.

Conventional electromagnetic loudspeaker drive units have two principal limits on their maximum acoustic output capability: excursion of the cone, and heat buildup. Excessive cone excursion adds distortion to the signal creating a desire to limit the cone excursion. Further, the drive unit temperature rises above tolerable limits if the electrical power-handling ability of the voice coil is exceeded and there is insufficient capacity for removing the resulting heat from the coil. Overly high temperatures ultimately result in a failure of the voice coil insulation, wire, and/or bonding of the voice coil to its former as the temperature of the internal parts becomes so great that electrical insulation and glue systems fail.

The maximum acoustic output limits may be changed if the loudspeaker drive unit is enclosed in a sealed or a vented box or a box equipped with a passive radiator in addition to the main driver. The maximum acoustic output limits may be further changed in more complex enclosures containing combinations of sealed sub-enclosures, vented sub-enclosures, or chambers equipped with passive radiators.

The limits on excursion of the loudspeaker drive unit at audio frequencies may also be changed by the presence of the enclosure because the acoustical load on the driver may be changed by the presence of the enclosure. The electrical power-handling ability may be changed by the presence of the enclosure because the enclosure typically adds to the thermal resistance of the system, and thus a given power input will produce a greater voice coil temperature rise for a driver enclosed in a box compared to a driver in free air.

Additionally, complete loudspeaker systems, as opposed to conventional drive units alone, have additional limits imposed on them due to upper limits on velocity of air in ports, or passive radiators undergoing excessive excursion. High velocity of air in the ports may cause extraneous noise, and passive radiator low frequency maximum excursion may be different from the maximum low frequency excursion of the principal drive units.

Good loudspeakers are designed for flat low-frequency response down to a practical lower limiting frequency, typically using methods explicated by Beranek and Locanthi in the 1950's. Beranek and Locanthi proposed electrical analogies for the electrical and mechanical systems of loudspeakers. These electrical analogies were brought to wide use as a practical system of measurements and application of those measurements by Thiele and Small in the 1960's and 70's. Complete low-frequency loudspeaker design work today is strongly influenced by the papers of Thiele and follow-on work by Small. Thiele produced a catalog of low-frequency responses, modeling loudspeakers as electrical high-pass filters. The models showed various alignments varying flatness of response, steepness of roll-off below the cutoff frequency, potential electrical equalization, group delay, excursion vs. frequency, and other factors. The Thiele-Small parameters have become the most prominent metric used nationally and internationally for the exchange of information about drivers, and have had enormous positive economic impact.

Low-frequency loudspeaker design today is typically an act of balancing a variety of specifications affecting bandwidth, frequency response over the bandwidth, maximum level capacity and its variation with frequency, various distortions, and cost. Among the target frequency response curves available for design from sources such as Thiele, some include separate electrical equalization before the power amplifier. Such equalization may be provided by an underdamped high-pass filter, with peaking of the high-pass filter response at the corner frequency of the high-pass filter made a part of the overall design.

An unaided (i.e., receiving an unfiltered input signal) loudspeaker mechanical and acoustical radiation system has a frequency response showing a particular low-frequency rolloff. Accurate sound production (i.e., a flat frequency response) may be extended to a frequency below the rolloff of the unaided loudspeaker mechanical and acoustical radiation system by providing electrical equalization in the form of an underdamped high-pass filter. Such electrical equalization increases the excursion of the associated loudspeaker driver at the peaking frequency of the high-pass filter and at frequencies around the peaking frequency. However, although such electrical equalization has the benefit of extending the system response below the rolloff frequency of the unaided loudspeaker mechanical and acoustical radiation system, because the electrical equalization increases the power below the rolloff frequency, the equalization raises both the electrical power dissipated as heat below the rolloff frequency and the excursion around and at the rolloff frequency, as shown in one example system and Thiele response alignment by Newman. These increases in heat and excursion may exceed a speaker's limits.

Once the utility of extending the bandwidth with a peaking high-pass filter became known, several inventors took the idea a step further to make the high-pass filter dynamic by various means, and with a varying fit to the excursion capability and power limits of the driver. Unfortunately, such attempts have failed to achieve the best possible fit of bandwidth extension while staying within the excursion and thermal limits of drivers.

Further, electrical equalization which includes a boost capability may be used to extend the frequency range downwards, but may also cause a reduction in the maximum sound pressure level capability vs. frequency typically by the same amount as the equalization vs. frequency response curve of the high-pass filter. Thus, a need remains for a system and method for extending low frequency performance of conventional loudspeaker driver-box systems, for example, open back, closed box, vented box, and their more complex variants composed of combinations of these types of parts, having limitation in their low-frequency response range and maximum sound pressure level capability vs. frequency.

The above described material and other related material is discussed in the following publications:

Beranek, Leo L., *Acoustics*, McGraw-Hill, New York, 1954;

Burg, T. C., Gao, X., Dawson, D. M., "Robust control for the improvement of loudspeaker low-frequency response," Southeastcon '93 Proceedings, IEEE, 1993;

"Improving Loudspeaker Signal Handling Capability," Application Note 104, That Corporation, Milford, Mass.;

Locanthi, B. N., "Application of Electric Circuit Analogies to Loudspeaker Design Problems," *IRE Trans. Audio* PGA-4 (1952), reprinted *J. Audio Eng. Soc.*, vol. 19, pps 775-785 (1971);

Newman, Raymond J. "Particular vented box loudspeaker system based on a sixth-order Butterworth response function," *J. Acoust. Soc. Am., vol.* 55, issue S1, April, 1974, pp. S29-30;

Small, Richard H., "Efficiency of Direct-Radiator Loudspeaker Systems," *J. Audio Eng. Soc.*, vol. 19, no. 10, 862-863, November 1971;

Small, Richard H., "Direct Radiator Loudspeaker System Analysis," *J. Audio Eng. Soc.*, vol. 20, no. 5, pp. 383-395;

Small, Richard H., "Vented-Box Loudspeaker Systems—Part 2: Large-Signal Analysis," *J. Audio Eng. Soc.*, vol. 21, no. 6, pp. 438-444, July/August 1973;

Thiele, A. N., "Loudspeakers in Vented Boxes: Parts I and II," *J. Audio Eng. Soc.*, vol. 19 no. 5 May, 1971, pp. 382-392 and no. 6 June, 1971, pp. 471-483; a reprint of *Proc. IRE* (Australia), vol. 22, p. 487-, 1961.

BRIEF SUMMARY OF THE INVENTION

The present invention addresses the above and other needs by providing electronic signal processing for loudspeakers. The signal processing addresses limitations of both drive unit(s) and their enclosure system. The enclosure systems may range from no enclosure through sealed boxes to vented or ported boxes, including bandpass design loudspeaker-box systems. The invention extends the unaided low-frequency limit of loudspeakers dynamically while staying within excursion limits of drive units and passive radiator(s), and within maximum velocity limits of the air in any port(s).

It is an object of the present invention to provide smooth and flat response to substantially lower frequencies than the unaided system for a given sound pressure level, while remaining within the excursion limits of the driver, excursion capability of any passive radiator, and velocity limit of any port. This objective is accomplished by processing a speaker input signal with a dynamic high-pass filter, where the filter varies from under to over-damped as a function of the speaker input signal to smoothly vary the center frequency and Q of the filter with the level magnitude spectrum of the input signal to provide a filtered speaker input signal matched to the capability of the driver. The amplitude response of the high-pass filter is smoothly adjusted by a controlling side chain, as a function of variations in input signal level. The controlling side chain adjusts the amplitude response from an under-damped and peaked response for low-signal levels to an over-damped rolled off response for higher levels. The response of the dynamic filter is utilized combined with the unfiltered response of the loudspeaker, the loudspeaker enclosure, and the effect of any ports or passive radiators, to produce a desired overall frequency response, varying with level.

One likely desired response is a flat frequency response, to the lowest frequency possible, for any given drive level over a range of levels, with a tolerance on response. The amplitude response of the dynamic high-pass filter is utilized to obtain the desired frequency response goal, consistent with staying within the capacity of excursion of drivers and possible passive radiators, and air velocity limits of any port. The principal dynamic high-pass filter may be any order above one, because order one (single pole) high-pass filters offer no potential for peaking and thus would not produce a benefit as foreseen by the invention. The frequency response of the high-pass filter is varied with input signal level to maintain flat response to a variable low-frequency limit. The frequency response is controlled to obtain an approximately equal excursion vs. level over a useful range of levels.

It is a further object of the present invention to limit the velocity of the air in any port to avoid the extraneous noise commonly called chuffing, and to limit the excursion of any passive radiator(s) to a maximum value consistent with the excursion capability of the radiator.

It is a further object of the present invention to equalize the speaker input signal to better match the output capacity of the driver-box vs. frequency. The equalization makes use of the observation that all box types, as well as no box at all, produce significantly more excursion of the driver below the nominal cutoff frequency of the loudspeaker system than above the cutoff frequency, as shown by Small. A separate frequency-band-limiting filter (e.g., low pass filter) is provided in a control side chain which controls the center frequency and Q of the dynamic high-pass filter. Controlling the center frequency and Q of the dynamic high-pass filter controls the level of the frequency content in program material below the nominal system low-frequency limit, which in turn limits the excursion of the loudspeaker drivers. The frequency-band-limiting filter includes a passband in the frequency range below the loudspeaker nominal operating range (i.e., the frequency range where the main driver experiences the most excursion), a transition band at approximately the lower corner frequency of the loudspeaker system, and a stopband at all higher frequencies. The imposition of such frequency-band-limiting filter permits matching the low-frequency bandwidth extension provided by the dynamic high-pass filter to the maximum permissible linear excursion of the driver.

For a relatively low-power system, the signal processing described above will extend the bandwidth of the system by boosting lower frequencies with an under-damped high-pass filter constrained to keep the system within excursion limits, and will protect the driver from over-excursion from signals that would normally be considered to be out of band. Higher-powered systems may include at least one additional limiting side chain generating a limiting signal applied after the dynamic high-pass filter in the signal path. The additional side chains provide limits based on the driver excursion, the velocity of air in ports or the excursion of any passive radiators, the onset of audible amplifier clipping, and/or the electrical power causing overheating of the driver.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
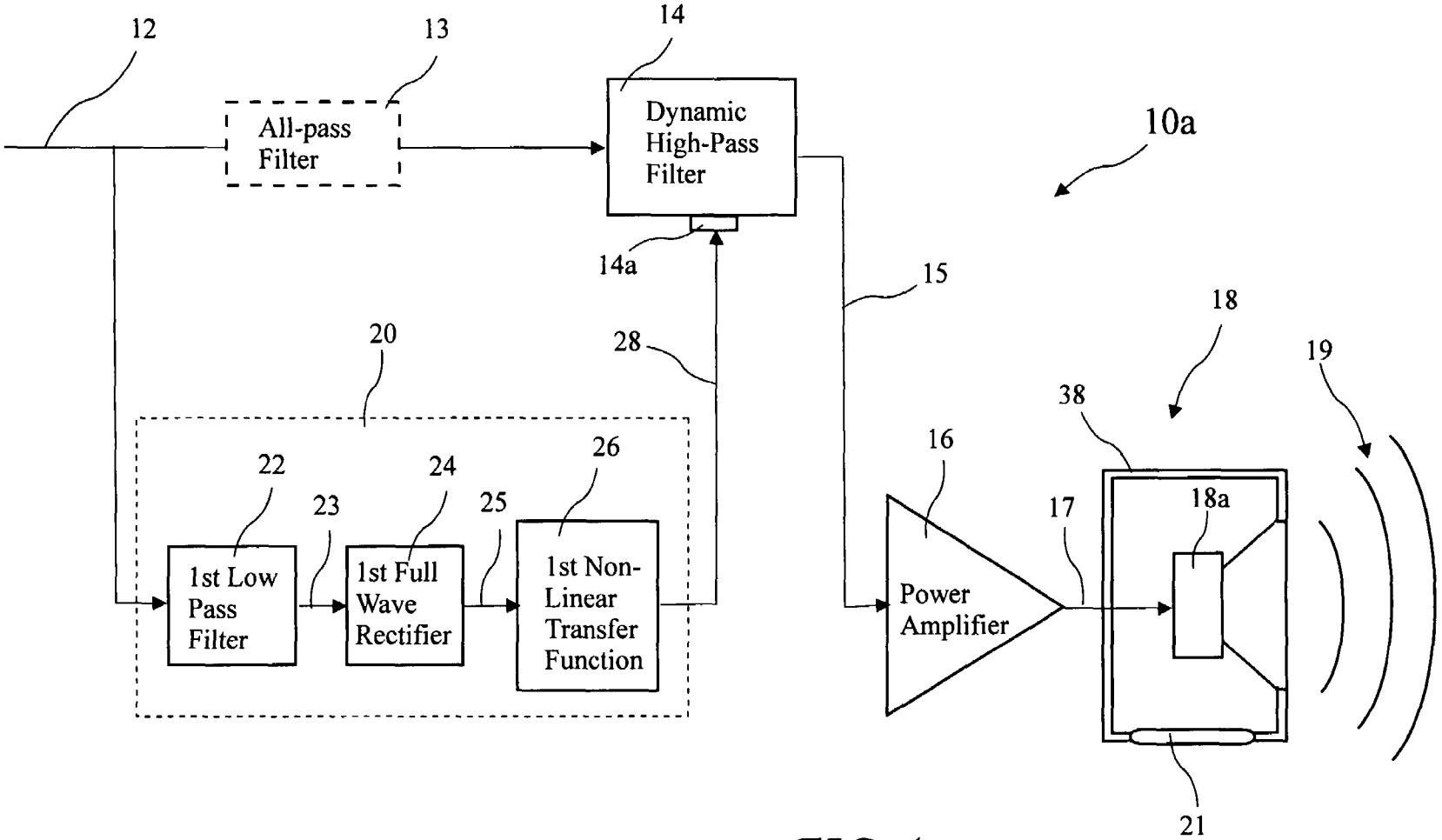
FIG. 1 is a first system according to the present invention for extending low frequency performance of a loudspeaker.

A first system 10*a* according to the present invention for extending low frequency performance of a loudspeaker is shown in FIG. 1. The system 10*a* includes a dynamic high-pass filter 14 having at least two poles and at least two zeros at the origin (which make it a high-pass filter). The dynamic high-pass filter 14 processes an unfiltered input signal 12 to generate a filtered signal 15 provided as an amplifier input signal to a power amplifier 16, and power amplifier 16 amplifies the filtered signal 15 to provide a speaker signal 17 to a loudspeaker 18. The loudspeaker 18 includes a speaker driver 18*a* residing in a speaker enclosure 38 and receiving the speaker signal 17, and one or more optional passive radiators 21 (or vents) residing on a side of the speaker enclosure 38. The system 10*a* is generally a relatively low-power system, for example, an approximately one watt to an approximately 20 watt system.

The dynamic high-pass filter 14 has a variable frequency and Q controlled by a first side chain 20. The side chain 20 comprises a first low-pass filter 22, a full wave rectifier 24, and a first non-linear transfer function circuit 26. The input signal 12 is provided to the low-pass filter 22 which processes the input signal 12 to generate a low-pass signal 23, the full wave rectifier 24 processes the low-pass signal 23 to generate a rectified (or absolute value) signal 25, and the non-linear transfer function circuit 26 processes the rectified signal 25 to generate a control signal 28 provided to a filter control port 14*a* on the high-pass filter 14.

The low-pass filter 22 has a filter passband from DC up to approximately the lowest speaker resonant frequency of the speaker enclosure 38 and any vent or passive radiator 21, a steep filter transition band rolling off the filter response around the speaker resonant frequency of the speaker enclosure 38 and any vent or passive radiator 21, and a filter stopband above the speaker resonant frequency of the speaker enclosure 38 and any vent or passive radiator 21. By placing the filter transition band of the low-pass filter 22 at approximately the lowest speaker resonant frequency of the speaker enclosure 38 and any vent or passive radiator 21, any excursion which occurs below the speaker resonant frequency is controlled by the high-pass filter 14 based on the control signal 28 generated by the side chain 20.

The output of the low-pass filter 22 is passed as low-pass signal 23 to the full wave rectifier 24 which computes the absolute value signal 25 of the signal 23 which accounts for both directions of excursion into and out of the speaker enclosure 38 by the loudspeaker driver 18*a*. The absolute value signal 25 is passed to the first non-linear transfer function 26. The transfer function 26 provides the control signal 28 to the dynamic high-pass filter 14 such that the filter 14 is extended to its maximum low-frequency and high Q limit at low levels of the signal 28, and then above a threshold, to progressively and proportionally adjust the frequency and Q of the dynamic high-pass filter 14 such that approximately equal excursion is reached over a useful range of levels, the excursion set by the maximum limits of the loudspeaker 18.

Figure 2:
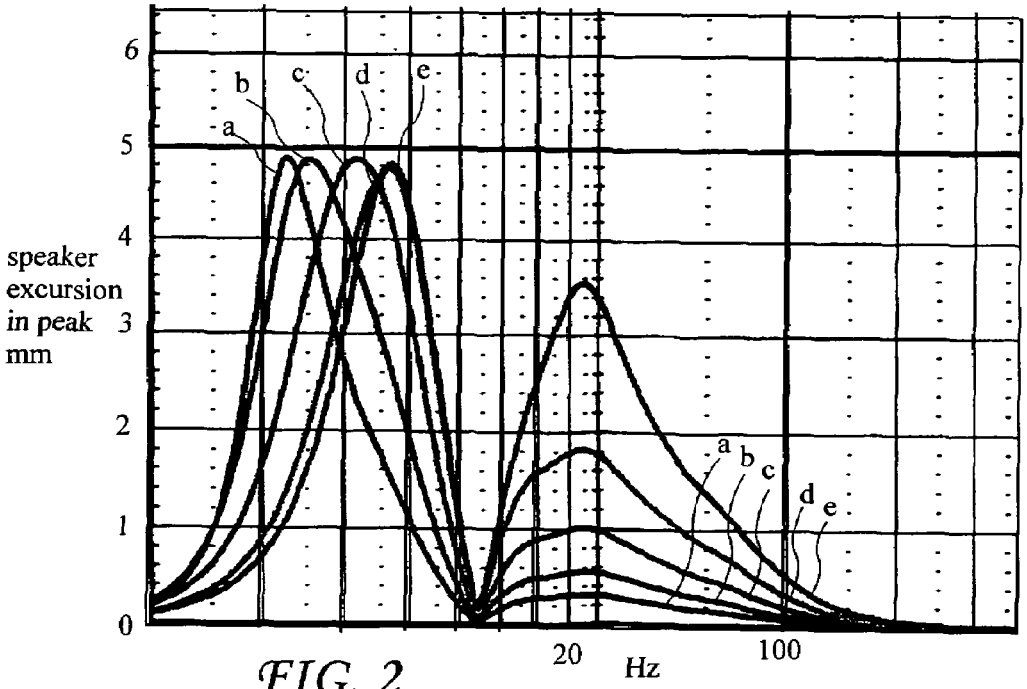
FIG. 2 shows a family of speaker excursion curves at various input signal levels demonstrating excursion limiting according to the present invention.

A family of transducer excursion curves a, b, c, d, and e for various levels of the input signal 12 applied to the system 1*a* (see FIG. 1), are shown in FIG. 2. The curves a, b, c, d, and e demonstrate that when the level of the absolute value signal 25 is below a threshold set by the design of the first non-linear transfer function 26, the maximum speaker excursion, below the principal low-frequency resonance, is kept to a limit and within a small variation over a useful range of levels of the input signal 12. When the level of the absolute value signal 25 is above the threshold, an increasing control signal 28 is delivered to the control port 14*a* of the dynamic high-pass filter 14 and the filtered signal 15 provided to the loudspeaker 18 is kept to limits which do not cause over-excursion of the loudspeaker below resonance of the vent or passive radiator.

Both the frequency and Q of the high-pass filter 14 may be varied by the control signal 28 with the high-pass filter 14 ranging from an underdamped condition to an overdamped condition. The underdamped condition of the high-pass filter 14 is in response to low levels of the control signal 28 and results in a peaked frequency response with a frequency response peak at least somewhat below the primary resonance of loudspeaker driver 18*a*, and speaker enclosure 38 with its associated vent or passive radiator. The primary resonance is the frequency of minimum cone motion and maximum vent output. The lower limiting frequency is usually considered to be the frequency at which the response is −10 dB below the in-band sensitivity of the system.

The overdamped condition of the high-pass filter 14 is in response to high levels of the control signal 28 and results in the dynamic high-pass filter 14 being overdamped and having a higher center frequency than at low levels of the control signal 28. The overdamped response results in no peaking of the frequency response curve, and the driver excursion protection is maximized. In the underdamped condition of the high-pass filter 14, the frequency response of the high-pass filter 14 may be used to extend the bandwidth of the total system typically by ⅓ to 1 octave in range, found as the frequency range extension accomplished by measuring the −3 dB overall system lower frequency limit. By careful control of the frequency and Q of the high-pass filter 14 versus level of the control signal 28, a flat response within a given target tolerance on response, for example approximately ±1.0 dB, may be accomplished across a range of levels of the control signal 28. As the level of the control signal 28 increases, the center frequency (which may not be the −3 dB frequency) of the high-pass filter 14 also increases, but is limited to maintain the excursion of the driver 18*a* to be kept within a specified excursion limit, such as $x_{max}$, or $x_{max}$+15%. The term $x_{max}$ is a commonly used descriptor for loudspeaker limiting excursion; the units of $x_{max}$ are linear dimensions such as millimeters.

The low-pass filter 22 produces a delay in the low-pass signal 23. In order to overcome a resulting insertion delay (i.e., the time difference between the main and side chain paths) in the control signal 28, and the variation with frequency (group delay) of the side chain low-pass filter 22, an all-pass filter 13 (see FIG. 1) may be inserted to process the input signal 12 provided to the high-pass filter 14. The all-pass filter 13 preferably would have the same insertion delay as, and the average group delay of, the low-pass filter 22. The all-pass filter 13 is preferably inserted in the main signal path between the input of the system 12 (after branching the signal 12 to the side chain 20) and before the dynamic high-pass filter 14. A second all-pass filter (or filters) may also be placed in main channels of a subwoofer-satellite system to maintain equal time of arrival for sound emanating from subwoofer and satellite type systems.

Figure 3A:
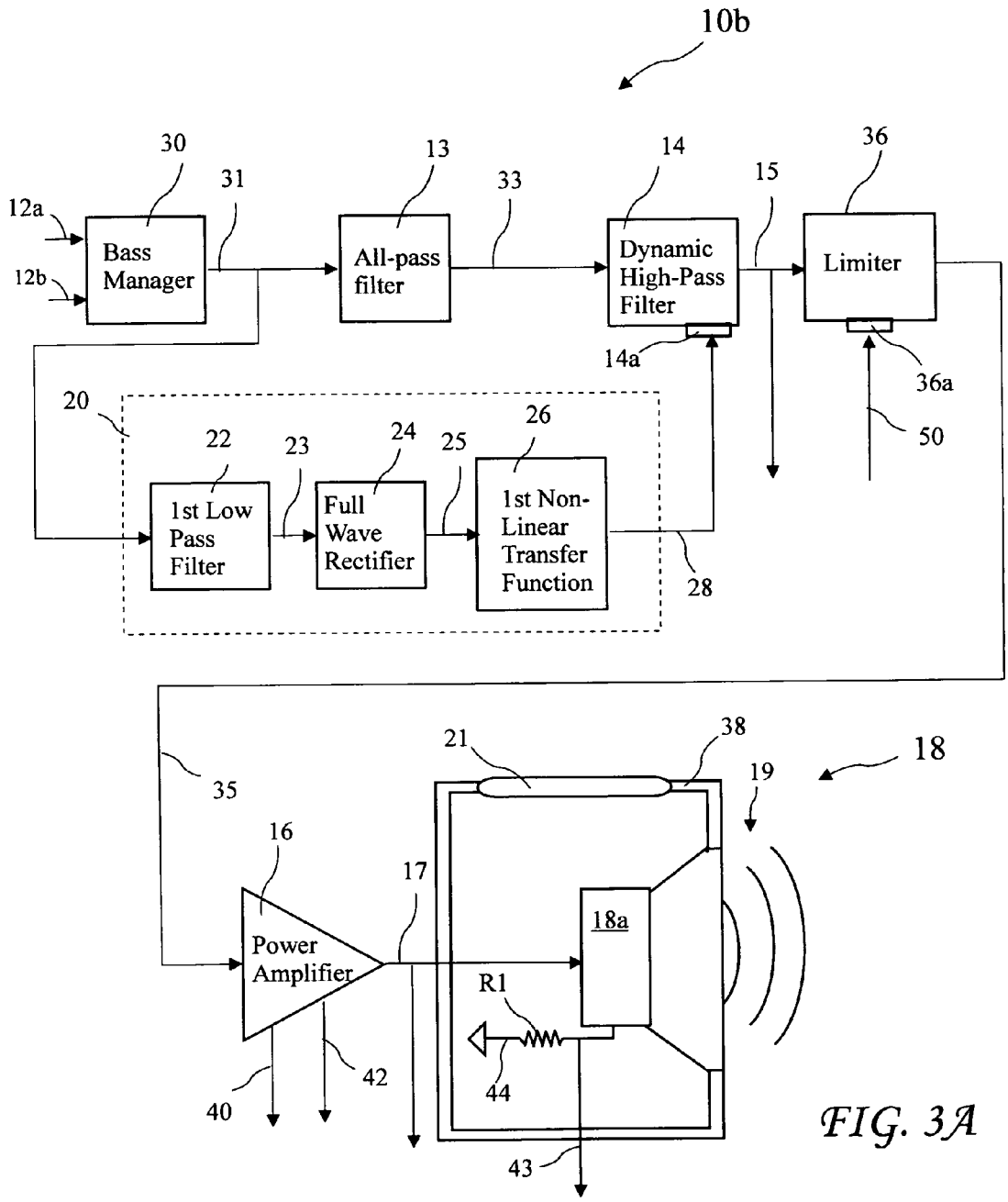
FIG. 3A is a first portion of a second system according to the present invention for extending low frequency performance of a loudspeaker.
Figure 3B:
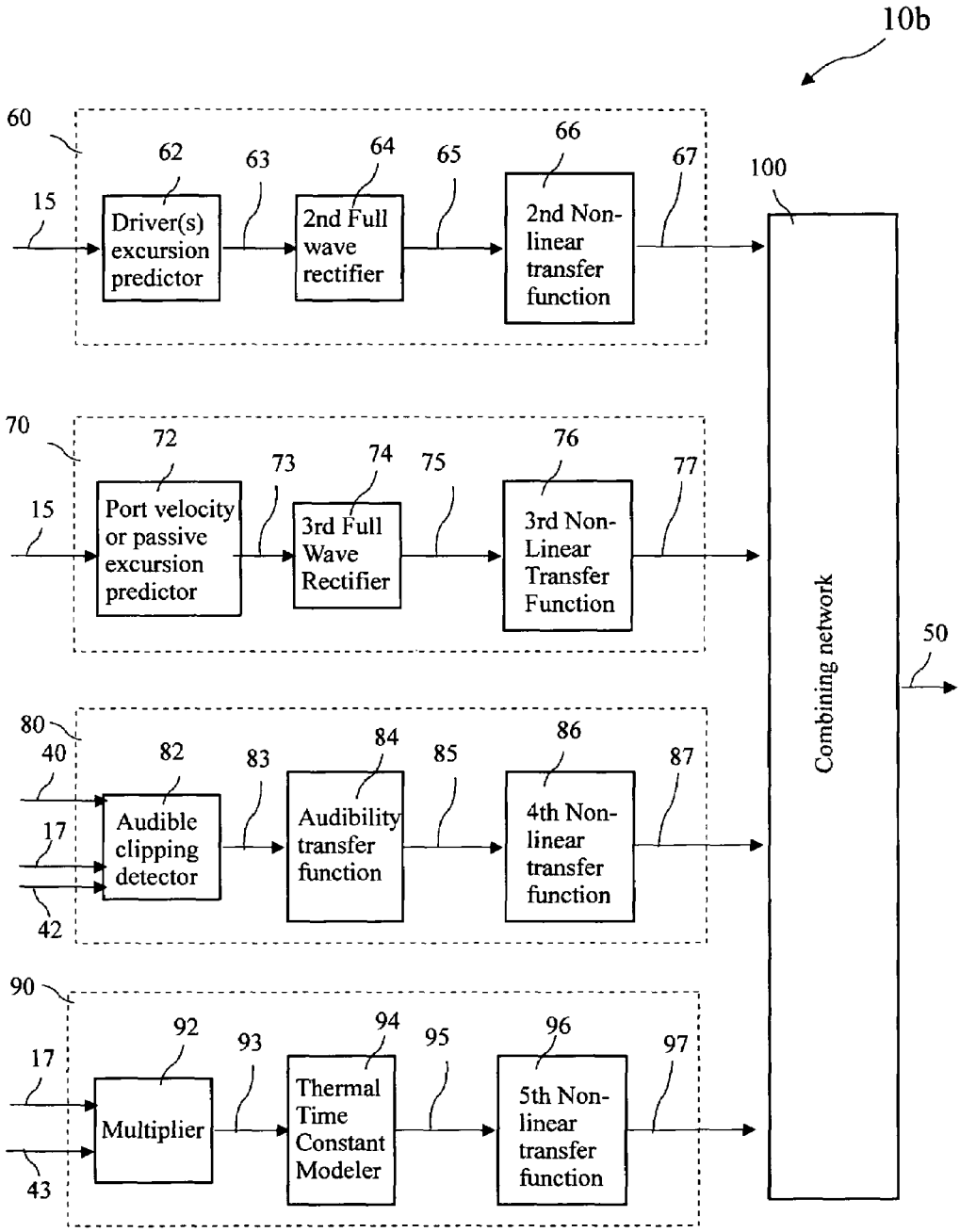
FIG. 3B is a second portion of the second system for extending low frequency performance of a loudspeaker.

A first portion of a second system 10*b* according to the present invention for extending low frequency performance of a loudspeaker is shown in FIG. 3A and a second portion of the second system 10*b* is shown in FIG. 3B. The system 10*b* includes a bass manager 30, the optional all-pass filter 13, the dynamic high-pass filter 14, a limiter 36 serially connected between the dynamic high-pass filter 14 and the power amplifier 16, and the controlling side chain 20 of the system 10*a*

(see FIG. 1). The system 10*b* includes additional limiting side chain loops 60, 70, 80, and 90 providing a limiting signal 50 to a limiter 36 located between the dynamic high-pass filter 34 and the power amplifier 16. Other embodiments of the present invention include at least one of the side chains 60, 70, 80, and 90.

The bass manager 30 high-pass filters each of the main channels, for example, channels 12*a* and 12*b* for a two channel system, and outputs them to their respective signal chains. Additionally, the bass manager 30 sums the channels 12*a* and 12*b* and low-pass filters the sum to provide a combined low-passed (or bass) signal 31 to the all-pass filter 13 and to the first side chain 20. In a conventional system, the combined low-passed signal 31 is sent on directly to a subwoofer amplifier and on to a subwoofer, or directly to a powered subwoofer. In the case of the present invention, the combined low-pass filtered signal 31 may be additionally processed as described herein using the present invention. The optional all-pass filter 13 processes the combined low-passed signal 31 to provide a delayed low-passed signal 33 to the dynamic high-pass filter 14. The system 10*b* is typically a high-power system, for example, a greater than approximately 20 watt system.

In another embodiment, the second system 10*b* may receive a pre-filtered input signal 12 (see FIG. 1) provided to the dynamic high pass filter 14 directly or through the all-pass filter 13, and to the side chain 20. In yet another embodiment not employ bass management, multiple implementations of the present invention may be used, channel by channel, in systems employing any number of channels.

The first limiting side chain loop 60 receives the filtered signal 15 generated by the dynamic high-pass filter 14. The object of the first limiting side chain loop 60 is limiting the speaker excursion to prevent the driver 18*a* from degrading or failing due to excessive excursion, and to keep non-linear overload distortion to within reasonable limits. The first limiting side chain loop 60 comprises in-series, a driver(s) excursion predictor 62, a second full wave rectifier 64, and a second non-linear transfer function 66. The excursion predictor circuit 62 is preferably a linear two-port network having a frequency response corresponding proportionally to driver excursion vs. frequency of the loudspeaker 18 comprising the loudspeaker driver 18*a*, speaker enclosure 38 and any port(s) or passive radiators employed, such as shown as passive radiator 21, and generates a predicted excursion signal 63 based on the filtered signal 15. The rectifier 64 is preferably a peak-type to predict the peak excursion, with appropriate attack and release time constants, and processes the predicted excursion signal 63 to generate a rectified excursion signal 65. The non-linear transfer function circuit 66 processes the rectified excursion signal 65 to generate a first limiting signal 67 comprising a zero or near zero output for low predicted excursions of the driver 18*a*, and proportionally greater output as the predicted excursion limit of the driver 18*a* is approached, causing a limiting effect as graphed in FIG. 4. The non-linear transfer function 66 provides the first limiting signal 67 to the combining network 100.

The second limiting side chain loop 70 receives the filtered signal 15 generated by the dynamic high-pass filter 14 and provides a second limiting signal 77 based on predictions of the velocity of air in any port, or of the excursion of a passive radiator 39. The side chain loop 70 includes a port velocity or passive excursion predictor 72, a third full wave rectifier 74, and a third non-linear transfer function 76. The side chain loop 70 generates a zero or near zero limiting signal 77 for low-level signals, and increases the limiting signal 77 as the port velocity predictions approach velocity limits or passive excursion predictions approach limits of the excursion of the passive radiator.

If the speaker enclosure 38 is a vented driver-box system, then the limiting side chain loop 70 comprises the following. The predictor 72 comprises a linear two-port system having one input port and one output port and having a frequency response corresponding proportionally to vent or port air velocity vs. frequency. The predictor 72 thus generates a prediction signal 73 of the vent or port velocity based on the filtered signal 15. The rectifier 74 is preferably a peak-detecting rectifier having suitable attack and release time constants. The non-linear transfer function 76 produces zero or near zero third rectified signal 75 for a low value of the prediction signal 73, and rapidly increasing the third rectified signal 75 for higher values of the prediction signal 73 (as a limit of non-turbulent air velocity is approached or exceeded), forming a limiting effect. An example of a maximum port velocity is approximately 35 m/s. The object of limiting the port velocity is to limit extraneous noise called "chuffing."

If the driver-box system 38 includes a passive radiator 21 rather than a vent or port, then the limiting side chain loop 70 comprises the following. The predictor 72 is an excursion versus frequency predictor for the passive radiator, and is preferably a linear two-port having a frequency response corresponding proportionally to the passive radiator excursion vs. frequency. If the loudspeaker 18 employs a combination of one or more ports or passive radiators, then the predictor 72 is an excursion predictor for the worst case of any of the techniques in use versus frequency. The predictor 72 generates the prediction signal 73 based on the filtered signal 15 and provides the prediction signal 73 to the full wave rectifier 74. The full wave rectifier 74 generates a third rectified signal 75 based on the prediction signal 73 and provides the rectified signal 75 to the non-linear transfer function 76.

In either case, the third non-linear transfer function 76 processes the third rectified signal 75 to generate a second limiting signal 77 provided to the combining network 100.

The side loop 80 limits or prevents audible clipping in the power amplifier 16 by processing the near instantaneous speaker signal 17 generated by the power amplifier 16 and comparing the output voltage of the instantaneous speaker signal 17 to the power supply rails +Vcc 40 and −Vcc 42. As either voltage +Vcc or −Vcc is approached by the speaker signal 17, an audible clipping detector 82 produces a detector output signal 83. An audibility transfer function 84 processes the detector output signal 83 and generates a clipping signal 85 which predicts the occurrence of audible clipping distortion, in other words, the likelihood of the onset audible clipping or the likelihood that the clipping distortion will be audible, based on the detector output signal 83. The audibility transfer function 84 may include a time constant corresponding to an estimate how long clipping must occur for it to become audible, the percentage of time in clipping, the spectral change resulting from clipping, or other transfer function providing a measure of clipping distortion.

Figure 4:
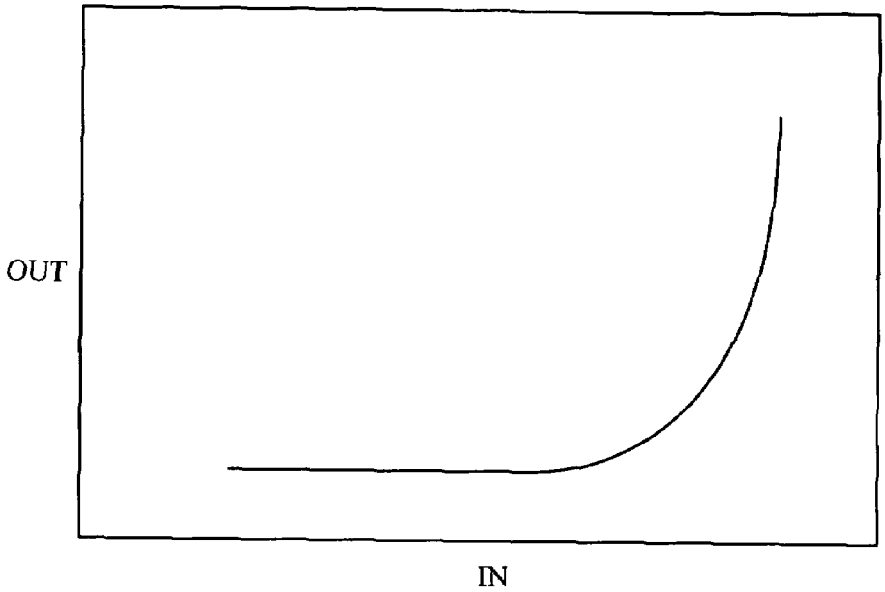
FIG. 4 is a graph of a limiting function as an excursion limit is approached.

The audibility transfer function 84 provides the clipping signal 85 to the fourth non-linear transfer function 86. The fourth non-linear transfer function 86 follows an input/output curve such as shown in FIG. 4. The fourth non-linear transfer function 86 provides the limiting output signal 87 to the combining network 100. At levels of the signal 85 where distortion remains below audibility, no effect on the control voltage 50 results. As the level where the signal 85 indicates that distortion is on the edge of becoming audible, the limiting output signal 87 of the non-linear transfer function 86 begins to rapidly increase, affecting the control voltage 50 and reducing or rendering audible distortion negligible.

The side loop 90 comprises a power limiting circuit including a multiplier 92, a thermal time constant modeler 94, and a fifth non-linear transfer function 96. The electrical power applied to the speaker 18, when evaluated with multiple concatenated time constants, is a reliable predictor of voice coil temperature. The voice coil temperature is in turn a reliable indicator of one principal kind of stress placed on loudspeaker 18, namely thermal stress. The multiplier 92 receives the instantaneous speaker signal 17 from the output of the power amplifier 16 and a voltage 43 representing the current through the loudspeaker 18*a* from the top of a low value current-sensing resistor R1 in series with a ground lead 44 of the loudspeaker 16. The multiplier 92 generates a multiplied signal 93 proportional to the instantaneous power dissipated in the loudspeaker 16 and is of such a type wherein either polarity of voltage on either input 17 or 43 provides a positive going output. The signal 93 is provided to the thermal time constant modeler 94 which will normally have multiple time constants to mimic the voice coil 18*a* temperature in light of the thermal resistance between the voice coil 18*a* and ambient, the thermal resistance comprising the thermal resistance of the voice coil 18*a*, and the transmission of heat to the surroundings of the voice coil 18*a*. The thermal time constant modeler 94 generates an estimate of the power consumed by the voice coil 18*a* weighted by appropriate time constants to represent the temperature of the voice coil 18*a* and provides the power estimate 95 to the non-linear transfer function 96 which generates a fifth limiting signal 97 provided to combining network 100. The non-linear transfer function 96 produces a zero limiting signal 97 for low levels of the power estimate 95, and produces an increasing limiting signal 97 for power estimates 95 above a threshold, at a rate to limit power to in-turn limit voice coil 18*a* temperature to a maximum of voice coil temperature. The maximum voice coil temperature is selected to be consistent with the dissipation capability of the voice coil and temperature rise of copper or aluminum wire, its insulation, its glue systems, and the integrity of any former on which the voice coil is wound, the glue bond between the former and the cone, and any other involved structures.

The combining network 100 combines the outputs of any or all of the four limiting side chains 60, 70, 80, and 90 to form a limiting signal 50 provided to the limiter 36 (see FIG. 3A). The signals 67,77,87, and 97, or any combination of them, are combined in the combining network 100, the function of which is to select the highest of any of the signals 67,77,87, and 97, or a weighted combination of the signals 67,77,87, and 97, and supply the resultant limiting signal 50 to a limiter control port 36*a* the limiter 36 located in the signal path after the dynamic high-pass filter 14. The limiter 36 limits the filtered signal 15 based on the limiting signal 50 to generate a limited amplifier input signal 35 provided to the amplifier 16. The limiting may be a hard ceiling or may be an "over easy" type of limiting having no effect at low levels, then progressively more limiting effect, then hard limiting.

Figure 5:
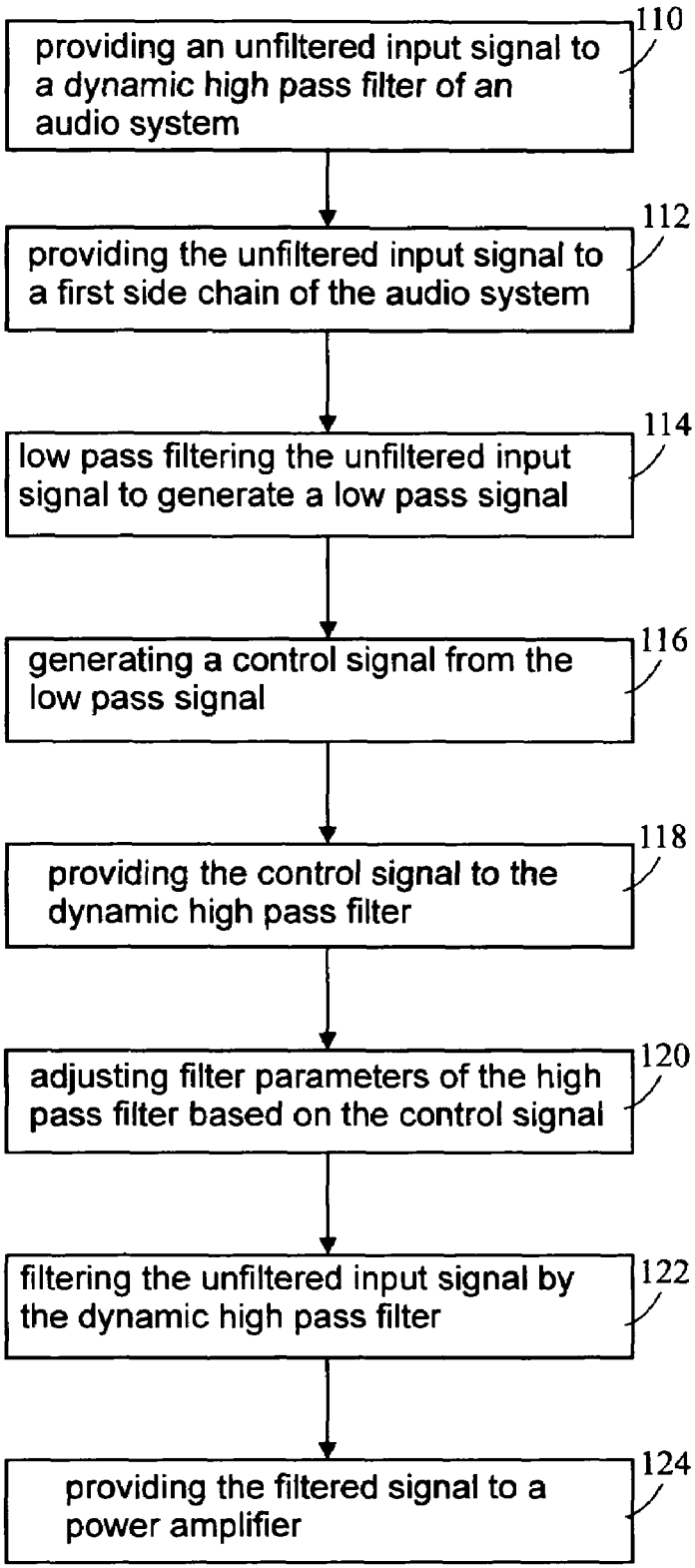
FIG. 5 is a first method according to the present invention for extending the low frequency bandwidth of an audio system.

A first method according to the present invention is described in FIG. 5. An unfiltered input signal is provided to a dynamic high pass filter of an audio system at step 110. The unfiltered input signal is also provided to a first side chain of the audio system at step 112. The unfiltered input signal is provided to a low pass filter to generate a low pass signal at step 114. A control signal is generated from the low pass signal at step 116. The control signal is provided to a control port of the dynamic high pass filter at step 118. The filter parameters of the high pass filter are adjusted based on the control signal at step 120. The unfiltered input signal is filtered by the dynamic high pass filter to generate a filtered signal at step 122. The filtered signal is provided to a power amplifier at step 124.

Figure 6:
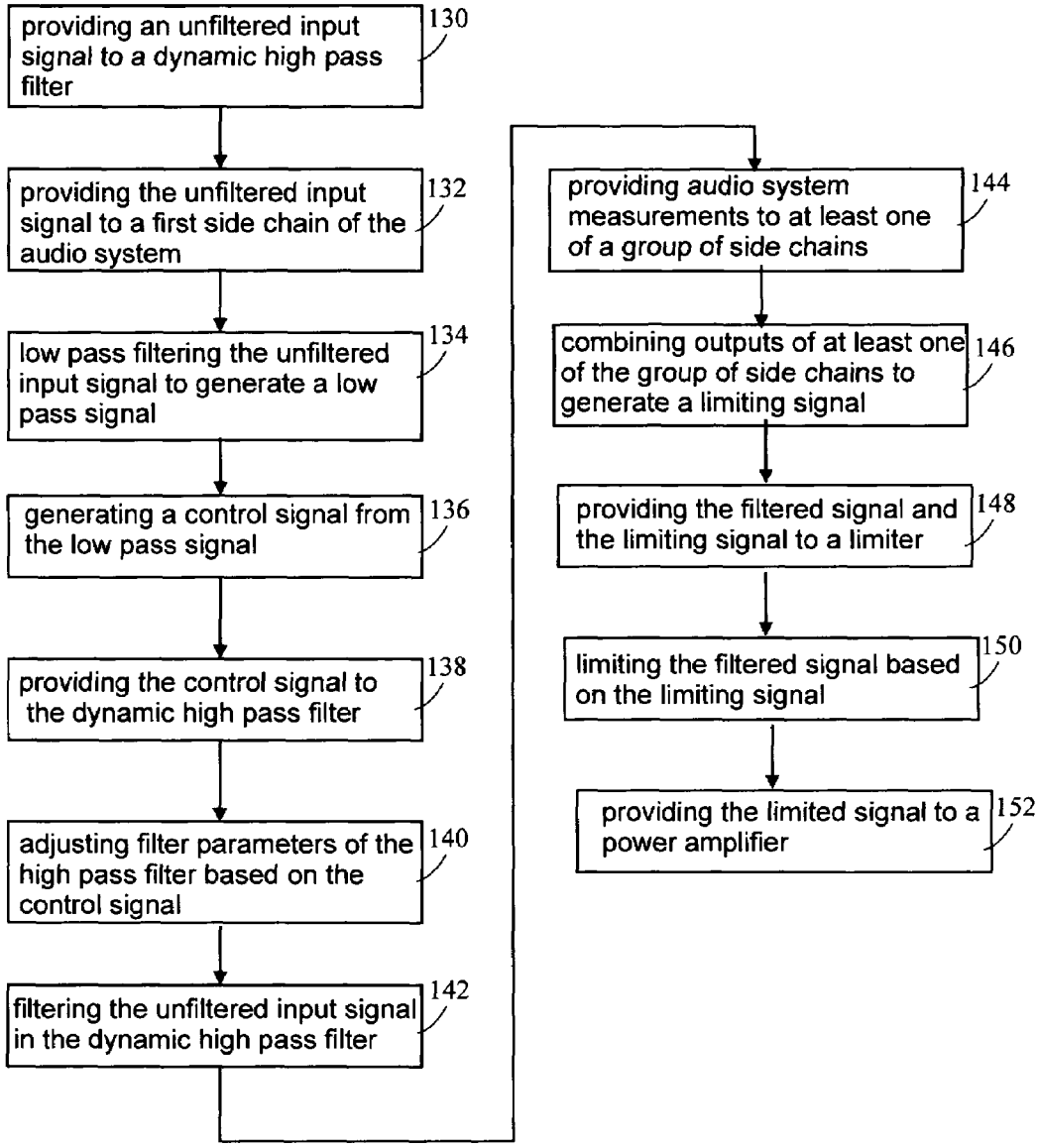
FIG. 6 is a second method according to the present invention for extending the low frequency bandwidth of an audio system.

A second method according to the present invention is described in FIG. 6. An unfiltered input signal is provided to a dynamic high pass filter of an audio system at step 130. The unfiltered input signal is also provided to a first side chain of the audio system at step 132. The unfiltered input signal is provided to a low pass filter in the first side chain to generate a low pass signal at step 134. A control signal is generated from the low pass signal at step 136. The control signal is provided to a control port of the dynamic high pass filter at step 138. The filter parameters of the high pass filter are adjusted based on the control signal at step 140. The unfiltered input signal is filtered by the dynamic high pass filter to generate a filtered signal at step 142. Audio system measurements are provided to at least one of a group of side chains at step 144. Outputs of at least one of the group of side chains are combined to generate a limiting signal at step 146. The filtered signal is provided to an input of a limiter and the limiting signal is provided to a control port of the limiter at step 148. The filtered signal is limited based on the limiting signal to generate a limited signal at step 150. The limited signal is provided to a power amplifier at step 152.

One skilled in the art will understand the foregoing as a description of feedforward control loops, used to predict excursion, power, etc., which are designed using control theory appropriate to such loops, such as scaling functions to make particular voltage or digital representation of voltage correspond proportionally to the effect being measured. Feedforward design may be preferred for its inherent stability, but feedback design through reorganization of the various blocks is clearly possible.

While the invention herein disclosed has been described by means of specific embodiments and applications thereof, numerous modifications and variations could be made thereto by those skilled in the art without departing from the scope of the invention set forth in the claims.

I claim:

1. A system for enabling low-frequency bandwidth extension and loudspeaker driver protection comprising:

a dynamic high-pass filter electrically connected to receive a speaker input signal and to generate a filtered signal, the dynamic high-pass filter having a filter control port for receiving a control signal, a dynamic high-pass filter frequency and Q controllable through the filter control port;

a control side chain comprising in series, a low-pass filter, a first full wave rectifier, and a first non-linear transfer function, the control side chain electrically connected to receive the speaker signal and to provide the control signal to the filter control port;

a power amplifier electrically connected to the dynamic high-pass filter to receive the filtered signal, the amplifier for amplifying the filtered signal to generate a speaker signal; and a loudspeaker electrically connected to the amplifier to receive the speaker signal, the loudspeaker for transducing the speaker signal to generate an acoustic signal.

2. The system of claim 1, wherein:

the loudspeaker comprises a voice coil and an enclosure system;

the dynamic high-pass filter has an order of two or more and an equal number of poles and zeros; and the dynamic high-pass filter frequency and Q are variable according to a function which ranges from:

underdamped at a lower frequency for a low value of the control signal to extend the loudspeaker to lower frequencies; and overdamped at a higher frequency for a high value of the control signal limit the loudspeaker within a useful bandwidth.

3. The system of claim 2, wherein the low-pass filter includes:

a substantially flat filter response in a passband up to a speaker transition band approximately coincident with a low-frequency passband limit of the loudspeaker;

a filter transition band approximately centered on the low-frequency passband limit of the loudspeaker; and a filter stop band in the frequency range above the filter transition band.

4. The system of claim 3, further including:

a limiter electrically connected between the dynamic high-pass filter and the amplifier and having a limiter control port; and at least one additional side chain electrically connected:

to the dynamic high-pass filter to receive the filtered signal generated by the dynamic high-pass filter; and to the limiter control port to provide a limiting signal to the limiter based on the filtered signal, thereby controlling the limiter.

5. The system of claim 4, wherein one of the at least one side chains comprises:

a driver excursion predictor;

a second full wave rectifier; and a second non-linear transfer function.

6. The system of claim 4, wherein one of the at least one side chains comprises:

a port velocity predictor;

a third full wave rectifier; and a third non-linear transfer function.

7. The system of claim 4, wherein one of the at least one side chains comprises:

a passive radiator excursion predictor;

a third full wave rectifier; and a third non-linear transfer function.

8. The system of claim 3, further including:

a limiter electrically connected between the dynamic high-pass filter and the amplifier and having a limiter control port; and at least one additional side chain electrically connected to the power amplifier to receive the speaker signal from the power amplifier, and electrically connected to the limiter control port to provide a limiting signal based at least partly on the speaker signal.

9. The system of claim 8, wherein one of the at least one side chains comprises:

an audible clipping predictor;

an audibility transfer function; and a fourth non-linear transfer function.

10. The system of claim 8, wherein one of the at least one side chains comprises a power measurement system comprising:

a multiplier of the voltage and current in the amplifier;

a thermal time constant modeler; and a fifth non-linear transfer function.

11. The system of claim 1, further including a limiter electrically connected between the dynamic high-pass filter and the amplifier, the limiter having a limiter control port; and at least two additional side chains electrically, each of the at least two additional side chains connected to one of:

the dynamic high-pass filter to receive the filtered signal from the dynamic high-pass filter; and the power amplifier to receive the speaker signal, each of the at least two additional side chains further electrically connected to a combining network, the combining network for combining limiting signals from each of the at least two side chains and electrically connected to the control port of the limiter to provide a combined limiting signal to the limiter.

12. The system of claim 11, wherein the combining network selects the highest signal from among its inputs as the combined limiting signal.

13. The system of claim 1, wherein the dynamic high-pass filter is preceded by an all-pass filter having a characteristic approximately equal to at least the average insertion and group delay of at least one of the side chains.

14. A method for extending the low frequency bandwidth of an audio system, the method comprising:

providing an unfiltered input signal to a dynamic high-pass filter;

providing the unfiltered input signal to a first side chain of the audio system;

low-pass filtering the unfiltered input signal to generate a low-pass signal with a transition band at approximately the lowest resonate frequency of a speaker enclosure of the audio system;

generating a control signal from the low-pass signal;

providing the control signal to a filter control port of the dynamic high-pass filter;

adjusting a frequency and Q of the high-pass filter based on the control signal to limit a speaker excursion of the audio system when the control signal is high;

filtering the unfiltered input signal in the dynamic high-pass filter using the adjusted filter parameters to generate a filtered signal;

providing the filtered signal to a power amplifier amplifying the filtered signal in the power amplifier to generate a speaker signal; and providing the speaker signal to a speaker.

15. The method of claim 14, further including:

providing the low-pass signal to a rectifier to generate a rectified signal; and generating the control signal from the rectified signal.

16. A method for extending the low frequency bandwidth of an audio system, the method comprising:

providing an input signal to a dynamic high-pass filter providing the input signal to a first side chain of the audio system;

low-pass filtering the input signal in the first side chain to generate a low-pass signal with a transition band at approximately the lowest resonate frequency of a speaker enclosure of the audio system;

generating a control signal from the low-pass signal;

providing the control signal to a filter control port of the dynamic high-pass filter;

adjusting the parameters of the dynamic high-pass filter based on the control signal to limit a speaker excursion of the audio system based on the control signal;

processing the input signal in the dynamic high-pass filter to generate a filtered signal;

providing audio system measurements to at least one of a group of side chains comprising:

an driver excursion limiting side chain;

a port velocity limiting side chain;

an audible clipping limiting side chain; and a power limiting side chain;

combining outputs of at least one of the group of side chains to generate a limiting signal;

providing the filtered signal to a limiter;

providing the limiting signal to a limiter control port of the limiter;

limiting the filtered signal based on the limiting signal to generate a limited signal;

providing the limited signal to a power amplifier;

amplifying the filtered signal in the power amplifier to generate a speaker signal; and providing the speaker signal to a speaker.

17. The method of claim 16, wherein the group of side chains includes the driver excursion limiting side chain and the audio system measurements include the filtered signal generated by the dynamic high-pass filter.

18. The method of claim 16, wherein the group of side chains includes the port velocity limiting side chain and the audio system measurements include the filtered signal generated by the dynamic high-pass filter.

19. The method of claim 16, wherein the group of side chains includes the audible clipping limiting side chain and the audio system measurements include the speaker signal generated by the power amplifier.

20. The method of claim 16, wherein the group of side chains includes the power limiting side chain and the audio system measurements include the speaker signal generated by the power amplifier.

* * * * *

UNITED STATES PATENT AND TRADEMARK OFFICE

CERTIFICATE OF CORRECTION

PATENT NO. : 8,019,088 B2
APPLICATION NO. : 11/656674
DATED : September 13, 2011
INVENTOR(S) : Holman It is certified that error appears in the above-identified patent and that said Letters Patent is hereby corrected as shown below:

ON THE TITLE PAGE:

Item 75, Inventors: The Inventor's first name Tomlison" should be "Tomlinson".

The Inventor's city "Yocca Valley" should be "Yucca Valley".

In the drawings, Sheet 2, Fig. 2, the labels "20" and "100" should be moved to the left as shown here:

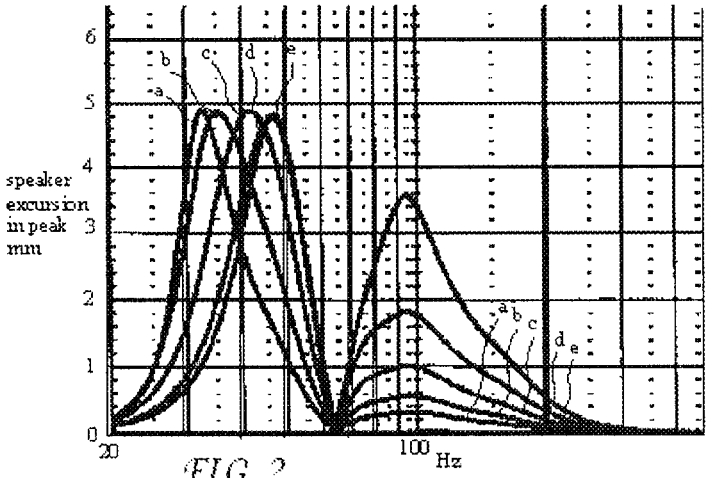

FIG. 2

Signed and Sealed this
Twenty-seventh Day of March, 2012

David J. Kappos

David J. Kappos
*Director of the United States Patent and Trademark Office*